US005477031A

United States Patent [19]

McWilliams

[11] Patent Number: 5,477,031

[45] Date of Patent: Dec. 19, 1995

[54] ELECTRICAL HEATING ELEMENT, ITS MANUFACTURE AND USE

[75] Inventor: Joseph A. McWilliams, Droitwich, United Kingdom

[73] Assignee: Ceramaspeed Limited, United Kingdom

[21] Appl. No.: 193,246

[22] Filed: Feb. 8, 1994

[30] Foreign Application Priority Data

Feb. 11, 1993 [GB] United Kingdom ..... 9302693
Sep. 24, 1993 [GB] United Kingdom ..... 9319785

[51] Int. Cl.[6] ..... H05B 3/74

[52] U.S. Cl. ..... 219/467; 219/468; 219/542; 219/463

[58] Field of Search ..... 219/467, 468, 219/465, 457, 463, 542, 543; 392/433, 434; 338/279, 280, 281, 282, 283, 284, 287, 288, 289, 291; 373/117, 128, 129, 130, 134

[56] References Cited

U.S. PATENT DOCUMENTS

| | | | |
|---|---|---|---|
| 600,057 | 3/1898 | Ball | 338/280 |
| 1,649,809 | 11/1927 | Campbell | 338/284 |
| 1,923,644 | 8/1933 | Simpson | 373/130 |
| 2,570,975 | 10/1951 | Osterheld | 219/37 |
| 3,612,829 | 10/1971 | Evans et al. | 219/464 |
| 3,912,905 | 10/1975 | Giler | 219/464 |
| 3,984,615 | 10/1976 | Beck | 219/532 |
| 4,292,504 | 9/1981 | Gebarowski et al. | 219/542 |
| 4,503,319 | 3/1985 | Moritoki | 338/283 |
| 4,864,105 | 9/1989 | Morgan | 219/542 |

FOREIGN PATENT DOCUMENTS 1569588 6/1980 United Kingdom .

*Primary Examiner*—Teresa J. Walberg
*Attorney, Agent, or Firm*—Ira S. Dorman

[57] ABSTRACT

An electrical heating element for a radiant electric heater takes the form of an elongate electrically conductive strip adapted for edgewise mounting on a base of thermal and electrical insulation material. The strip includes an elongate continuous portion and a discontinuous portion integral, and preferably coplanar, with the continuous portion, the discontinuous portion including a plurality of mounting tabs extending in a direction away from the continuous portion at spaced-apart locations, for securement to or in the base. Provided in each tab is at least one aperture such as a hole or slot or slit, so that thermal conduction into the tabs from the continuous portion is reduced or minimized and also variation in electric current density along the continuous portion of the strip is reduced or minimized when the strip is electrically connected for operation in a radiant electric heater.

60 Claims, 5 Drawing Sheets

ELECTRICAL HEATING ELEMENT, ITS MANUFACTURE AND USE

This invention relates to an electrical heating element for a radiant electric heater, more particularly, but not exclusively, for use with a glass-ceramic smooth top cooker. More particularly, the invention relates to a heating element in the form of an elongate strip of electrically conductive material, such as a metal or a metal alloy, arranged for edgewise mounting on a base of thermal and electrical insulation material by means of integral tabs extending edgewise therefrom and secured to or in the insulating base. The invention also relates to a method of manufacturing such an electrical heating element and to a radiant electric heater incorporating such an electrical heating element.

BACKGROUND TO THE INVENTION

When a heating element is secured to a base by tabs and brought to radiance for heating purposes by passing an electric current through it, there is a disadvantage in that the strip glows less brightly in the regions adjacent to the tabs. The reason for this is two-fold. Firstly, heat is conducted from the strip into the mounting tabs and then into the base. Thermal conduction into the base can be reduced somewhat by employing a base with very good thermal insulation properties, a particular example of such being microporous thermal insulation material. Secondly, it is found that the electric current density in the strip varies along the length of the strip, being lower in the regions adjacent the tabs than elsewhere. In such regions the strip is effectively wider on account of the tabs, and electric current flows though the tabs in addition to the strip, so resulting in the lower current density referred to above.

Strip-type heating elements are known, for example, from GB-A-1 569 588, U.S. Pat. No. 600,057 and U.S. Pat. No. 4,292,504.

According to GB-A-1 569 588 the heating conductor strip is slotted alternately from opposite edges to give the conductor strip a zig-zag form and anchoring tabs extend from the strip and penetrate an insulating sheet to secure the strip to the sheet. The tabs may be notched some distance from the lower edge of the strip to form a bending point. Thus, the heating part of the strip is discontinuous and there is no teaching of providing holes, slots or slits in the tabs to improve the uniformity of radiance of the strip along its length.

According to U.S. Pat. No. 600,057, a heating element may be provided in strip form, but there is no consideration of improving the uniformity of radiance of the strip along its length.

According to U.S. Pat. No. 4,292,504, a heating element of expanded metal is supported on edge substantially along its entire length on a board of insulating material. Because the heating part of the strip is discontinuous and no discrete tabs are provided the problems of uniform radiance are not the same as those encountered with a continuous heating strip.

The term 'microporous' is used herein to identify porous or cellular materials in which the ultimate size of the cells or voids is less than the mean free path of an air molecule at NTP, i.e. of the order of 100 nm or smaller. A material which is microporous in this sense will exhibit very low transfer of heat by air conduction (that is collisions between air molecules). Such microporous materials include aerogel, which is a gel in which the liquid phase has been replaced by a gaseous phase in such a way as to avoid the shrinkage which would occur if the gel were dried directly from a liquid. A substantially identical structure can be obtained by controlled precipitation from solution, the temperature and pH being controlled during precipitation to obtain an open lattice precipitate. Other equivalent open lattice structures include pyrogenic (fumed) and electrothermal types in which a substantial proportion of the particles have an ultimate particle size less than 100 nm. Any of these particulate materials, based for example on silica, alumina or other metal oxides, may be used to prepare a composition which is microporous as defined above.

The microporous insulation typically comprises a dry particulate microporous material as defined hereinabove mixed with ceramic fibre reinforcement, titanium dioxide opacifier and, for high-temperature use, a small quantity of alumina powder to resist shrinkage. Such microporous insulation material is described in GB-A-1 580 909.

OBJECT OF THE INVENTION

It is an object of the present invention to provide an electrical heating element which overcomes or minimises the problem of non-uniformity of radiance and in which the radiance of the heating element is more uniform along the length thereof. It is also an object of the present invention to provide an economical method of manufacturing such an electrical heating element and it is an object to provide a radiant electric heater incorporating such an electrical heating element.

SUMMARY OF THE INVENTION

According to one aspect of the present invention there is provided an electrical heating element for a radiant electric heater, the element comprising an elongate electrically conductive strip adapted for edgewise mounting on a base of thermal and electrical insulation material, the strip comprising an elongate continuous portion and a discontinuous portion integral with the continuous portion, the discontinuous portion comprising a plurality of mounting tabs extending in a direction away from the continuous portion at spaced-apart locations, for securement to or in the base, there being provided in each tab at least one aperture, whereby thermal conduction into the tabs from the continuous portion is reduced or minimised and also variation in electric current density along the continuous portion of the strip is reduced or minimised when the strip is electrically connected for operation in a radiant electric heater.

The term "continuous" is used herein in respect of the continuous portion of the strip to denote an elongate portion of the strip which is of substantially uniform dimensions. In contrast, the term "discontinuous" is used herein in respect of the discontinuous portion of the strip to denote a portion of the strip, adjacent to the continuous portion, which is provided with tabs which extend in a direction away from the continuous portion such that the cross-sectional area of material, in a direction substantially perpendicular to the elongate direction of the continuous portion of the strip, is variable in the elongate direction of the strip. Thus, at some points in the elongate direction of the strip the cross-sectional area of material may be substantially reduced as compared with other points, or there may be no material at all.

By appropriate selection of the size and location of the apertures in relation to the tabs, it can be arranged to reduce or minimise reduction in temperature in the continuous portion of the strip in the regions of the tabs during electrical self-heating of the strip in those situations where such reduction in temperature would otherwise be caused by thermal conduction from the strip into the tabs and by an effective increase in cross-section of the strip at the region of the tabs resulting from the presence of the tabs.

According to a another aspect of the present invention there is provided a radiant electric heater comprising a base of thermal and electrical insulation material and an electrical heating element partially embedded therein, the electrical heating element comprising an elongate electrically conductive strip comprising an elongate continuous portion and a discontinuous portion integral with the continuous portion, the discontinuous portion comprising a plurality of mounting tabs extending in a direction away from the continuous portion at spaced-apart locations, the tabs being secured on or in the base, preferably by embedding in the base, there being provided in each tab at least one aperture, whereby thermal conduction into the tabs from the continuous portion is reduced or minimised and also variation in electric current density along the continuous portion of the strip, when energised, is reduced or minimised.

Advantageously, the base of thermal and electrical insulation material may comprise microporous thermal and electrical insulation material.

Suitable microporous thermal and electrical insulation materials are well-known in the art, for example as described in GB-A-1 580 909, a typical composition being:

Microporous pyrogenic silica 49 to 97% by weight

Ceramic fibre reinforcement 0.5 to 20% by weight

Opacifier 2 to 50% by weight

Alumina up to 12% by weight

The proportion of alumina is preferably in the range from 0.5 to 12 percent by weight.

An additional advantage resulting from the invention is that the apertures in the mounting tabs provide enhanced securing of the strip when the strip is mounted with the tabs embedded in the base of insulation material.

The discontinuous portion of the strip may be substantially coplanar with the continuous portion thereof.

The at least one aperture may be in the form of a slot or a slit which extends into and along each tab from the extremity thereof remote from the continuous portion.

The or each aperture may be straight, bent or curved and of uniform or non-uniform shape.

A plurality of apertures may be provided in each tab either parallel to, or at an angle to, each other.

The width of the discontinuous portion of the strip may be greater than the length of the tabs and the or each slot or slit may extend beyond its associated tab and into the remainder of the discontinuous portion of the strip.

Alternatively, the at least one aperture may be in the form of at least one hole provided in the discontinuous portion. When at least one aperture is in the form of a single hole provided for each tab this may suitably be of a size so as to be as large as possible commensurate with its associated tab. The width of the discontinuous portion may be greater than the length of the tabs and the or each hole may be dimensioned to extend beyond its associated tab and into the remainder of the discontinuous portion of the strip.

The optimum location, length, shape and relative configuration of the at least one aperture can be readily determined by simple experiment for any particular strip with tabs.

Thus, by means of the invention a strip-form radiant heating element mounted on an insulating base by means of tabs integral therewith can be provided which demonstrates improved uniformity of visible radiance along its length when in operation.

The strip may, if required, be provided of corrugated (sometimes also known as sinuous or serpentine or convoluted) form along its length.

The strip and tabs suitably comprise a metal or a metal alloy, such as, for example, an iron-chromium-aluminium alloy. However the invention is not limited to any particular material or configuration of the strip.

For economy of manufacture of the heating element, the tabs are preferably uniformly spaced apart along the strip and with dimensions such that gaps between the tabs form complementary profiles of the tabs.

It may be advantageous to provide the heating element of the invention with one or more selected regions which operate in a heater at a lower temperature and/or with lower visible radiance than the remainder of the element. This may be required, for example, at terminal regions of the element, particularly where these are long, such as is necessary in terminating the inner heating element of a concentric arrangement of separate inner and surrounding outer heating elements. It may also be required for visually isolating regions of a heating element, for example to produce one or more isolated patterns in the heating element. Such selected regions for operating at a lower temperature and/or with lower visible radiance may be suitably formed with localised increase in effective cross-sectional area over a required length, or required lengths, of the conductive strip. This may be effected by localised increased thickness of the strip and/or increased effective width of the strip. The apertures may be omitted from appropriate tabs in the or each selected region. Alternatively, a plurality of spaced-apart tabs at the or each selected region may be replaced by a single elongate tab extending along the or each selected region and without apertures formed therein. As a further alternative, an additional piece of electrically conductive material may be bonded to the strip at the or each selected region to locally increase the thickness of the strip, and optionally the width of the strip, at the or each region. Such additional piece of conductive material may conveniently be formed of the same material as the strip, although it may comprise any other suitable metal or metal alloy.

According to a further aspect of the present invention there is provided a method of manufacturing an electrical heating element for a radiant electric heater, the element comprising an elongate electrically conductive strip adapted for edgewise mounting on a base of thermal and electrical insulation material, the strip comprising an elongate continuous portion and a discontinuous portion integral with the continuous portion, the discontinuous portion comprising a plurality of mounting tabs extending in a direction away from the continuous portion at spaced-apart locations, for securement to or in the base, the tabs being uniformly spaced apart along the strip and being dimensioned such that gaps between the tabs form complementary profiles of the tabs, there being provided in each tab at least one aperture, in which at least two lengths of strip are produced simultaneously by separation from a single conductive strip, by means of a cutting, punching or stamping operation, the at least two lengths being side by side on the strip with the tabs of one element being effectively interdigitated with the tabs of the other element as the separating operation is effected.

The discontinuous portion of the strip may be substantially coplanar with the continuous portion thereof.

The at least one aperture may be in the form of a slot or a slit which extends into and along each tab from the extremity thereof remote from the continuous portion.

The or each aperture may be straight, bent or curved and of uniform or non-uniform shape.

A plurality of apertures may be provided in each tab either parallel to, or at an angle to, each other.

The width of the discontinuous portion of the strip may be greater than the length of the tabs and the or each slot or slit may extend beyond its associated tab and into the remainder of the discontinuous portion of the strip.

Alternatively, the at least one aperture may be in the form of at least one hole provided in the discontinuous portion. When at least one aperture is in the form of a single hole provided for each tab this may suitably be of a size so as to be as large as possible commensurate with its associated tab. The width of the discontinuous portion may be greater than the length of the tabs and the or each hole may be dimensioned to extend beyond its associated tab and into the remainder of the discontinuous portion of the strip.

The strip may be formed into corrugated form along its length.

The strip and tabs suitably comprise a metal or a metal alloy, such as, for example, an iron-chromium-aluminium alloy.

The heating element may be manufactured with one or more selected regions which operate in a heater at a lower temperature and/or with lower visible radiance than the remainder of the element. This may be required, for example, at terminal regions of the element, particularly where these are long, such as is necessary in terminating the inner heating element of a concentric arrangement of separate inner and surrounding outer heating elements. It may also be required for visually isolating regions of a heating element, for example to produce one or more isolated patterns in the heating element. Such selected regions for operating at a lower temperature and/or with lower visible radiance may be suitably formed with localised increase in effective cross-sectional area over a required length, or required lengths, of the conductive strip. This may be effected by localised increased thickness of the strip and/or increased effective width of the strip. The apertures may be omitted from appropriate tabs in the or each selected region. Alternatively, a plurality of spaced-apart tabs at the or each selected region may be replaced by a single elongate tab extending along the or each selected region and without apertures formed therein. As a further alternative, an additional piece of electrically conductive material may be bonded to the strip at the or each selected region to locally increase the thickness of the strip, and optionally the width of the strip, at the or each region. Such additional piece of conductive material may conveniently be formed of the same material as the strip, although it may comprise any other suitable metal or metal alloy.

The invention is now described by way of example with reference to the accompanying drawings in which:

DESCRIPTION OF PREFERRED EMBODIMENTS

Figure 1:
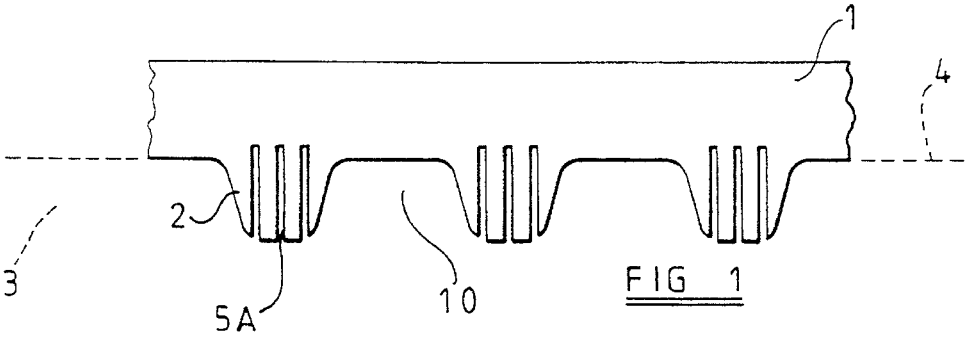
FIG. 1 is a side elevational view of a first embodiment of an electrical heating element according to the present invention and having mounting tabs incorporating apertures in the form of slits.
Figure 2:
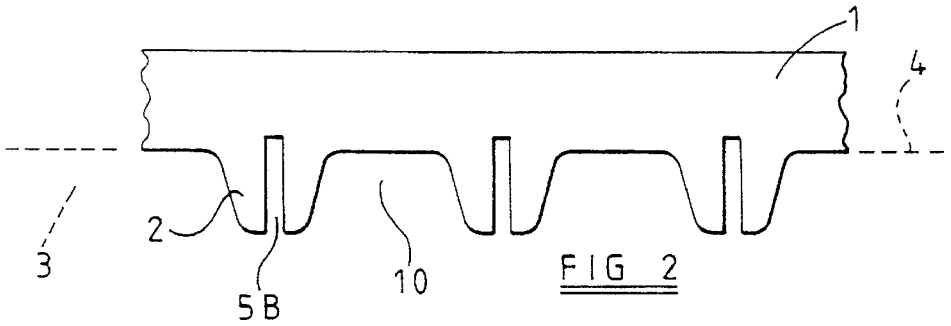
FIG. 2 is a side elevational view of a second embodiment of an electrical heating element according to the present invention and having mounting tabs incorporating apertures in the form of slots.
Figure 3:
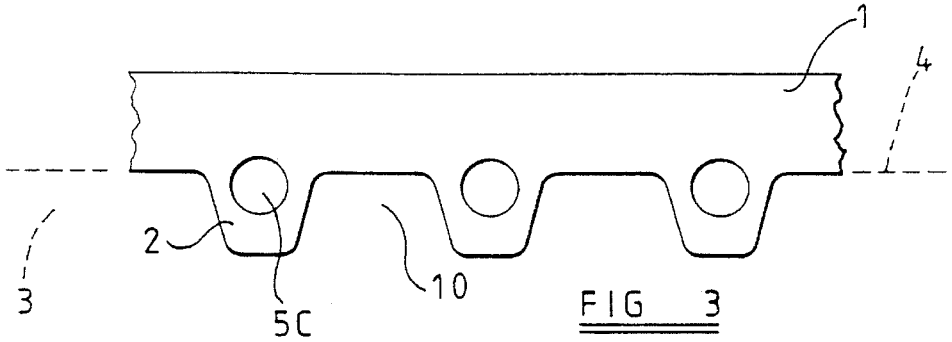
FIG. 3 is a side elevational view of a third embodiment of an electrical heating element according to the present invention and having mounting tabs incorporating apertures in the form of holes.

An electrical heating element for a radiant electric heater comprises an elongate electrically conductive strip 1, of a metal or a metal alloy, which has integral mounting tabs 2 spaced apart along its length and extending from an edge thereof in the plane of the strip. The strip 1 is intended to be mounted edgewise on a base 3 of thermal and electrical insulation material by embedding the tabs 2 in the base 3 to a level shown by the dashed line 4. By way of example, the base 3 suitably comprises microporous thermal and electrical insulation material such as that described in GB-A-1 580 909. As shown in FIG. 1, the tabs 2 are provided with apertures in the form of slits 5A extending from the lower edge thereof. As shown in FIG. 2, an aperture in the form of a slot 5B is provided in each tab 2, extending from the lower edge thereof. As shown in FIG. 3, an aperture in the form of a hole 5C is provided in each tab 2. Although the hole 5C is shown as circular in FIG. 3, it may be another shape such as rectangular or oval, according to the shape of the tabs 2.

The slits 5A, slots 5B and holes 5C fulfil a common purpose. In their absence, if the strip 1 were to be operated as a radiant heating element by passing an electric current along it, it would be observed that the region of the strip 1 immediately above each tab 2 would glow less brightly than the remainder of the strip 1. The reason for this is two fold. In addition to the electric current flowing along the strip 1, it would also flow through the tabs 2, and the effective increased width of the strip 1 in the regions of the tabs 2 caused by the tabs would result in a lower electric current density in these regions compared with that in the remainder of the strip. Hence slower and less heating of the strip occurs in these regions. Furthermore, heat would also be lost from the strip into the tabs by thermal conduction. By means of the present invention, the provision of the slits 5A, slots 5B, or holes 5C in the tabs 2 reduces thermal conduction into the tabs from the strip and also compensates for or reduces or eliminates flow of electric current through the tabs 2. Hence the flow of current along the strip 1 is as if the tabs 2 are substantially not present. Consequently the electric current density is substantially uniform along the strip 1 and the strip 1 glows with greater uniformity of brightness or radiance along the length thereof when in operation as a heating element compared with a similar strip without the apertures.

Figure 4:
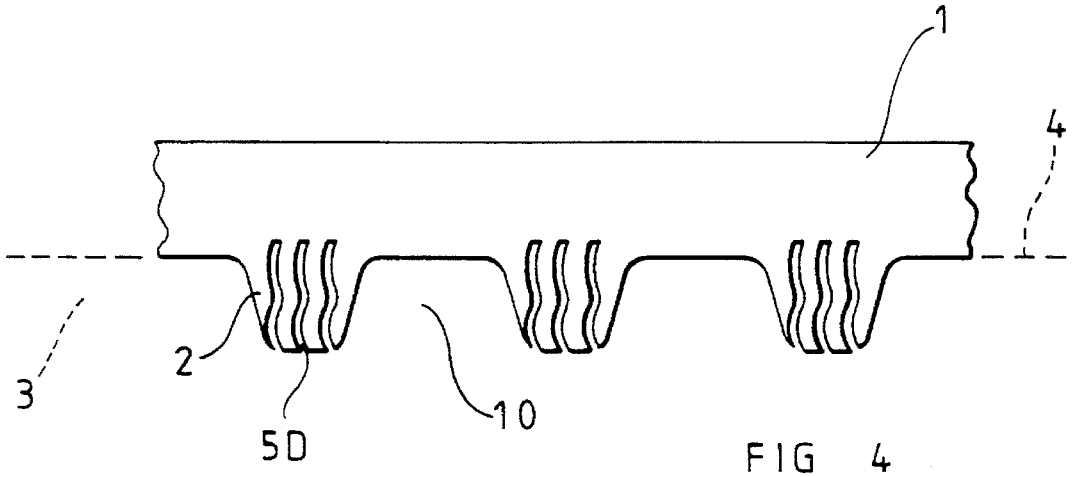
FIG. 4 is a side elevational view of a fourth embodiment of an electrical heating element according to the present invention and having mounting tabs incorporating apertures in the form of bent or curved slits.
Figure 5:
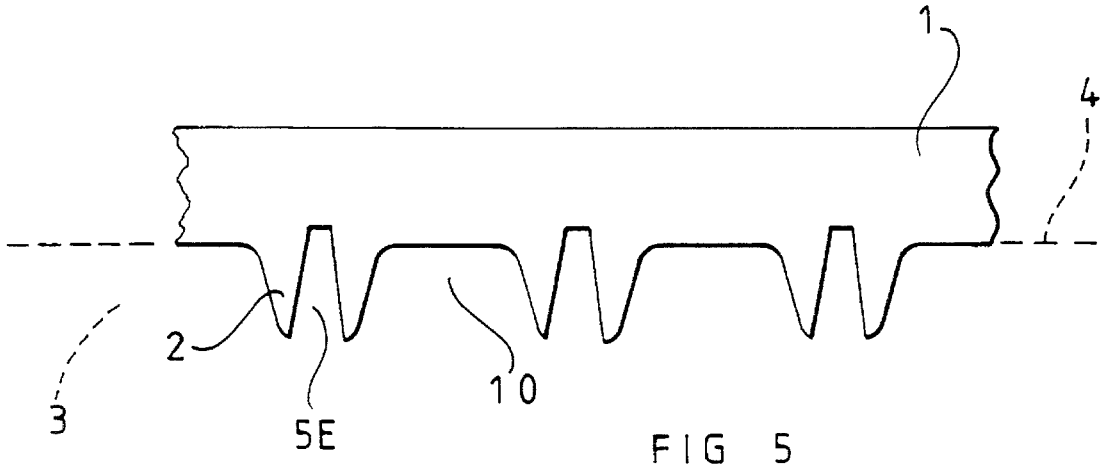
FIG. 5 is a side elevational view of a fifth embodiment of an electrical heating element according to the present invention and having mounting tabs incorporating apertures in the form of non-uniform slots.

The length, shape and number of the slits 5A or slots 5B and the size and location of the holes 5C required for maximum effect can be readily determined by simple experiment. It may be required for the slits 5A, slots 5B or holes 5C to extend somewhat beyond the tabs 2 and into the body of the discontinuous portion of the strip 1 itself as shown in FIGS. 1, 2 and 3. In general, each hole 5C should be made as large as is reasonably possible in relation to the size of its associated tab 2. The slits or slots could, if required, be bent or curved as shown by the apertures in the form of slots 5D in FIG. 4 and could be provided of non-uniform shape or width as shown by the apertures in the form of slots 5E in FIG. 5. A plurality of apertures in the form of slits or slots, when provided in each tab, could be arranged non-parallel to each other, if required.

Figure 6:
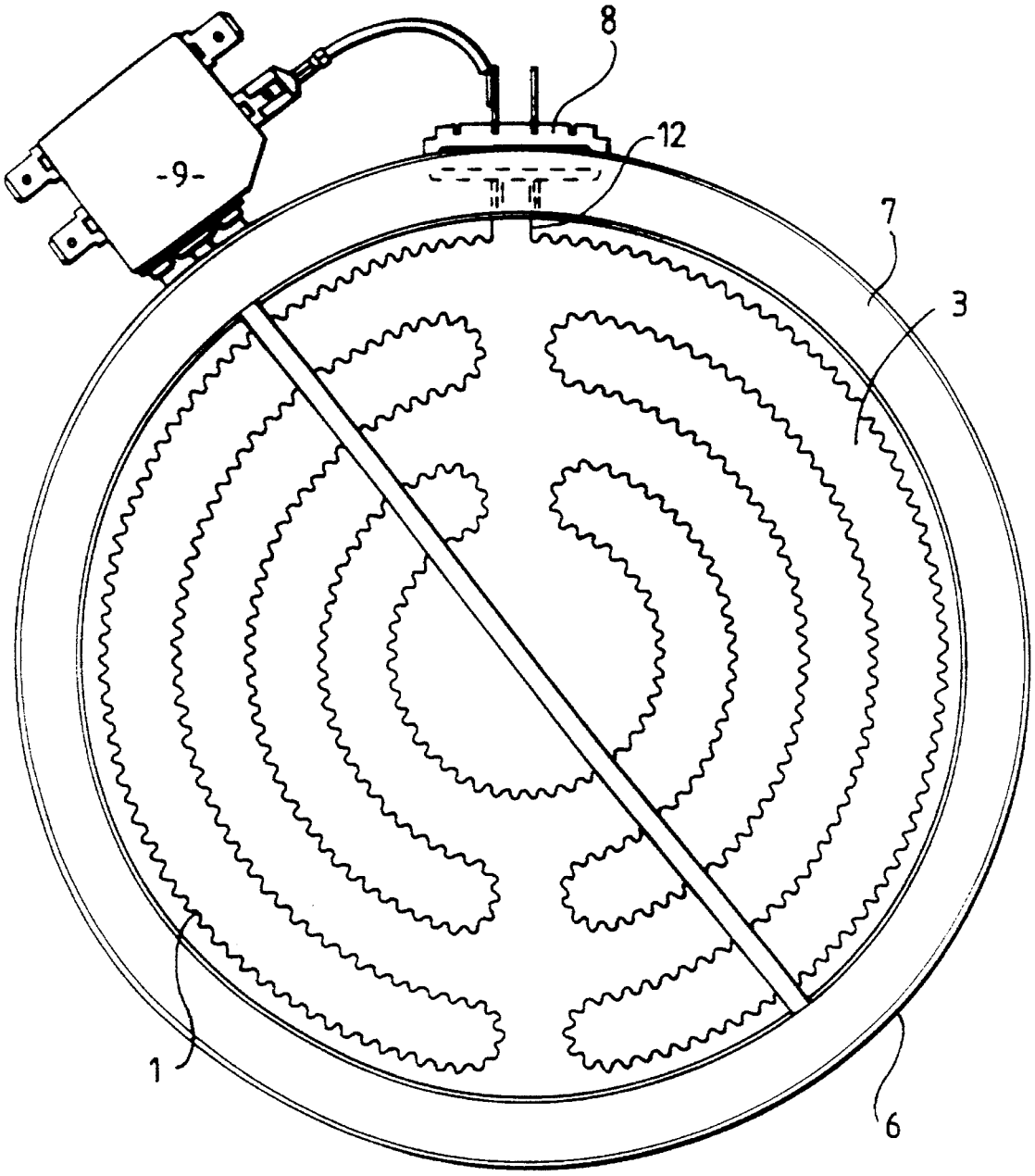
FIG. 6 is a plan view of a radiant electric heater incorporating a heating element of any one of FIGS. 1 to 5.

FIG. 6 illustrates an application of a heating element according to the invention in a radiant electric heater for use under a glass-ceramic plate of a smooth top cooker. A heating element comprising an elongate electrically conductive strip 1 of a metal or metal alloy, such as an iron-chromium-aluminium alloy, constructed as shown in any of FIGS. 1 to 5 and described above with reference thereto, is made into corrugated form and is mounted edgewise on the surface of a base layer 3 of microporous thermal and electrical insulation material compacted into a metal dish 6. Tabs 2 (FIGS. 1 to 5) on the strip 1 are embedded in the base layer 3, for example by pressing them into the base layer 3. After mounting the strip 1, the surface of the base layer 3 is arranged to be substantially at a level shown by reference numeral 4 in FIGS. 1 to 5. I have found that microporous thermal insulation material, even when compacted into a metal dish, retains a certain amount of resilience and this assists in retaining the tabs 2 in the base due to friction.

Against the side of the dish 6 is located a peripheral wall 7 of thermal insulation material, such as ceramic fibre material or microporous insulation material.

A terminal connector 8 is provided for electrically connecting the heating element strip 1 to an electrical supply.

A well-known form of thermal cut-out device 9 is provided, extending over the heating element to switch off the heating element in the event of overheating of the glass-ceramic plate when the heater is installed and operating in a cooker which incorporates such a glass-ceramic plate.

The heating element strip 1 operates advantageously as described above with reference to FIGS. 1 to 5, the presence of apertures in the form of slits, slots or holes (5A, 5B, 5C, 5D and 5E in FIGS. 1, 2, 3, 4 and 5 respectively) resulting in improved uniformity of brightness of radiation from the strip 1 and also providing a secondary advantage of enhancing securement of the tabs 2 in the insulation material 3.

Figure 7:
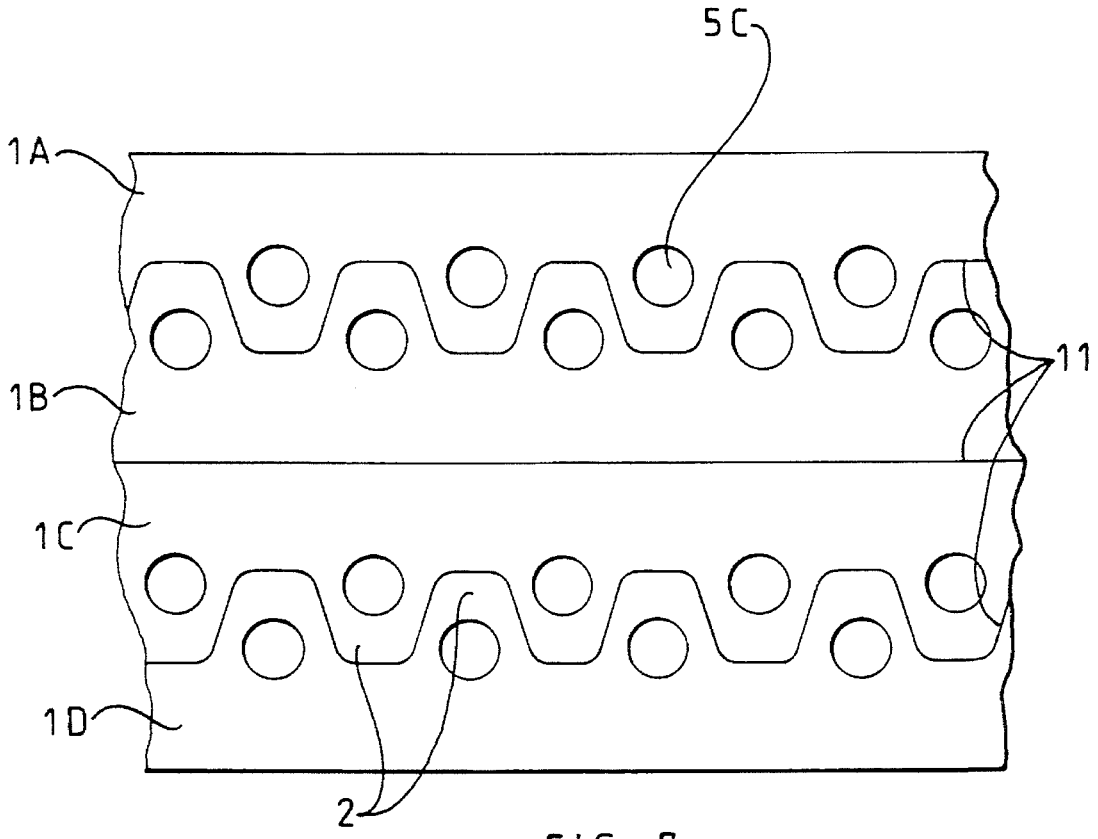
FIG. 7 is a plan view of portions of electrical heating elements of the invention during manufacture.

Economy of manufacture of the heating element strip illustrated in FIGS. 1 to 5 can be improved if the gaps 10 between the tabs 2 are made somewhat narrower than shown and are shaped and dimensioned such that they represent in form exact complementary profiles of the tabs 2. Lengths of elements of this form can be produced with minimum wastage of material as illustrated in FIG. 7. In FIG. 7, four lengths of heating element strips 1A, 1B, 1C and 1D are simultaneously produced in known manner from a single band of material by a suitable cutting, punching or stamping operation, holes 5C (or alternative apertures such as slots or slits similar to those denoted by reference numerals 5A, 5B, 5D or 5E in FIGS. 1 to 4) being appropriately located therein. The cutting, punching or stamping operation results in separation of the band along the lines of demarcation 11, into the four lengths of heating element strip 1A, 1B, 1C, 1D. Apart from the material removed to form the holes 5C, substantially no other wastage occurs in this process.

Figure 8A:
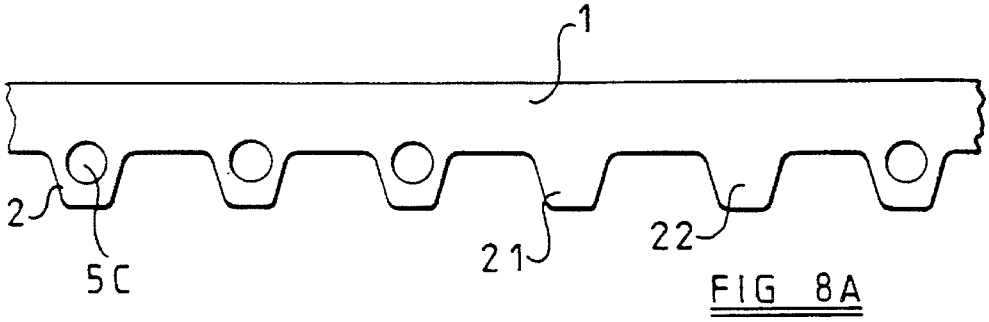
FIGS. 8A to 8C are side elevational views of portions of an electrical heating element of the invention having alternative arrangements for providing one or more selected regions for operation in a heater at a lower temperature and/or with lower visible radiance than the remainder of the element.
Figure 8B:
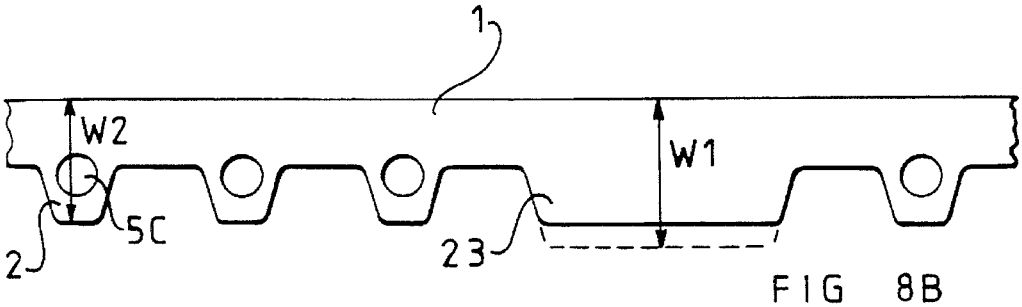
Figure 8C:
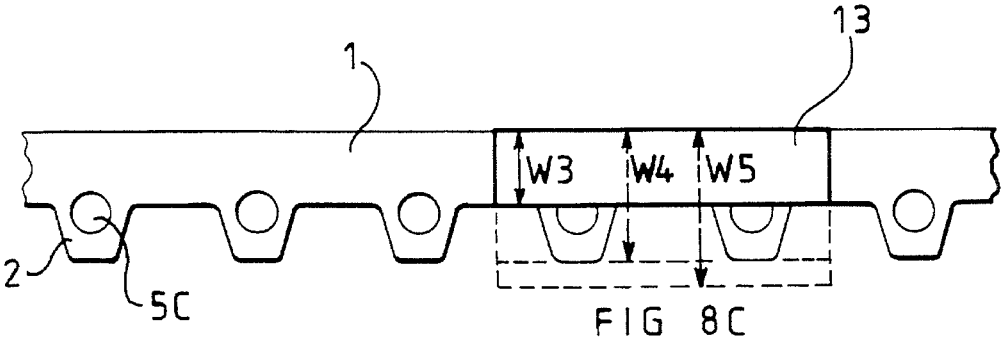

There may be requirements for providing the heating element strip of the invention with one or more selected regions which operate in a heater at a lower temperature and/or with lower visible radiance than the remainder of the strip. This may be required, for example, at terminal regions of the heater, for example at the regions 12 in FIG. 6. Such terminal regions may be quite long, particularly in a heater where two or more separately connected concentric heating elements are provided and it is necessary to provide low-radiating terminal portions extending from a heating element in a central zone of the heater to a connector at the periphery of the heater. It may also be required to provide visual isolation of selected regions of a heating element, for example to give the visual impression that a portion of the heating element 1 in FIG. 6 is separate from the remainder of the heating element 1. Such selected regions may be provided by localised increase in the effective cross-sectional area of the heating element strip 1 over one or more required lengths thereof. Examples of ways in which this may be achieved are illustrated in FIGS. 8A, 8B and 8C. Referring to FIG. 8A, the holes 5C have been omitted in tabs 21, 22 in the strip 1 to form the selected regions of lower operating temperature. Referring to FIG. 8B, the tabs 2 with holes 5C are replaced by an effectively elongate tab 23 without any holes, at each required selected region. If desired, the width W1 of the region of the strip with this elongate tab 23 may be extended to be greater than the width W2 of the remainder of the strip.

As a further alternative, the strip 1 may be increased in thickness at the one or more selected regions. This is preferably achieved, as illustrated in FIG. 8C by bonding, for example welding, an additional piece of electrically conducting material 13 to the surface of the strip 1, covering each required selected region of the strip 1. This measure may also be carried out as an addition to those described with reference to FIGS. 8A and 8B. The width of the additional piece of material 13 may be such that the additional piece of material either covers only the portion of the strip excluding the tabs 2 (W3), or covers the portion of the strip including the tabs 2 (W4), or somewhat exceeds the width of the strip and tabs (W5). The additional piece of material 13 is conveniently formed of the same material as the strip 1, but may comprise any other appropriate metal or metal alloy.

The arrangements shown in FIGS. 8A, 8B, 8C also apply where the tabs are provided with other forms of aperture such as slots or slits, as shown in FIGS. 1, 2, 4 and 5, instead of holes.

I claim:

1. An electrical heating element for a radiant electric heater, the element comprising an elongate electrically conductive strip adapted for edgewise mounting on a base of thermal and electrical insulation material, the strip comprising an elongate continuous portion and a discontinuous portion substantially co-extensive with the continuous portion, the discontinuous portion comprising a plurality of mounting tabs extending in a direction away from the continuous portion at spaced-apart locations, for securement to or in the base, there being provided in each tab at least one aperture, whereby thermal conduction into the tabs from the continuous portion is reduced or minimised and also variation in electric current density along the continuous portion of the strip is reduced or minimised when the strip is electrically connected for operation in a radiant electric heater.

2. An electrical heating element according to claim 1, wherein the discontinuous portion of the strip is substantially coplanar with the continuous portion thereof.

3. An electrical heating element according to claim 1, wherein the at least one aperture is in the form of at least one slot which extends into and along each tab from the extremity thereof remote from the continuous portion.

4. An electrical heating element according to claim 3, wherein the at least one slot is straight.

5. An electrical heating element according to claim 3, wherein the at least one slot is curved.

6. An electrical heating element according to claim 3, wherein the at least one slot is of uniform shape.

7. An electrical heating element according to claim 3, wherein the at least one slot is of non-uniform shape.

8. An electrical heating element according to claim 3, wherein the width of the discontinuous portion of the strip is greater than the length of the tabs and wherein the or each slot extends beyond its associated tab and into the remainder of the discontinuous portion of the strip.

9. An electrical heating element according to claim 1, wherein the at least one aperture is in the form of at least one slit which extends into and along each tab from the extremity thereof remote from the continuous portion.

10. An electrical heating element according to claim 9, wherein the at least one slit is straight.

11. An electrical heating element according to claim 9, wherein the at least one slit is curved.

12. An electrical heating element according to claim 9, wherein the at least one slit is of uniform shape.

13. An electrical heating element according to claim 9, wherein the at least one slit is of non-uniform shape.

14. An electrical heating element according to claim 9, wherein the width of the discontinuous portion of the strip is greater than the length of the tabs and wherein the or each slit extends beyond its associated tab and into the remainder of the discontinuous portion of the strip.

15. An electrical heating element according to claim 1, wherein the at least one aperture is in the form of at least one hole provided in the discontinuous portion.

16. An electrical heating element according to claim 1, wherein the width of the discontinuous portion of the strip in a direction perpendicular to the longitudinal direction of the strip and in the plane of the strip is greater than the lengths of the tabs in said perpendicular direction and the at least one aperture is dimensioned to extend in a direction towards the continuous portion of the strip beyond its associated tab and into the remainder of the discontinuous portion of the strip.

17. An electrical heating element according to claim 1, wherein the strip is provided of corrugated form along its length.

18. An electrical heating element according to claim 1, wherein the material of the strip is selected from the group consisting of a metal and a metal alloy.

19. An electrical heating element according to claim 1, wherein the tabs are uniformly spaced apart along the strip and are dimensioned such that gaps between the tabs form complementary profiles of the tabs.

20. An electrical heating element according to claim 1, wherein at least one selected region of the heating element is formed with a localised increase in effective cross-sectional area over a predetermined length of the conductive strip such that the at least one selected region operates in a heater at a lower temperature and/or with lower visible radiance than the remainder of the element.

21. An electrical heating element according to claim 20, wherein the localised increase in cross-sectional area is achieved by increased thickness of the strip.

22. An electrical heating element according to claim 20, wherein the localised increase in cross-sectional area is achieved by increased effective width of the strip.

23. A radiant electric heater comprising a base of thermal and electrical insulation material and an electrical heating element partially embedded therein, the electrical heating element comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, the tabs being secured on or in the base, there being provided in each tab at least one aperture, whereby thermal conduction into the tabs from the continuous portion is reduced or minimised and also variation in electric current density along the continuous portion of the strip, when energised, is reduced or minimised.

24. A radiant electric heater according to claim 23, wherein the tabs are secured by embedding in the base.

25. A radiant electric heater according to claim 23, wherein the insulation material comprises microporous thermal and electrical insulation material.

26. A radiant electric heater according to claim 23, wherein the discontinuous portion of the strip is substantially coplanar with the continuous portion thereof.

27. A radiant electric heater according to claim 23, wherein the at least one aperture is in the form of at least one slot which extends into and along each tab from the extremity thereof remote from the continuous portion.

28. A radiant electric heater according to claim 27, wherein the at least one slot is straight.

29. A radiant electric heater according to claim 27, wherein the at least one slot is curved.

30. A radiant electric heater according to claim 27, wherein the at least one slot is of uniform shape.

31. A radiant electric heater according to claim 27, wherein the at least one slot is of non-uniform shape.

32. A radiant electric heater according to claim 27, wherein the width of the discontinuous portion of the strip is greater than the length of the tabs and wherein the or each slot extends beyond its associated tab and into the remainder of the discontinuous portion of the strip.

33. A radiant electric heater according to claim 23, wherein the at least one aperture is in the form of at least one slit which extends into and along each tab from the extremity thereof remote from the continuous portion.

34. A radiant electric heater according to claim 33, wherein the at least one slit is straight.

35. A radiant electric heater according to claim 33, wherein the at least one slit is curved.

36. A radiant electric heater according to claim 33, wherein the at least one slit is of uniform shape.

37. A radiant electric heater according to claim 33, wherein the at least one slit is of non-uniform shape.

38. A radiant electric heater according to claim 33, wherein the width of the discontinuous portion of the strip is greater than the length of the tabs and wherein the or each slit extends beyond its associated tab and into the remainder of the discontinuous portion of the strip.

39. A radiant electric heater according to claim 23, wherein the tabs are uniformly spaced apart along the strip and are dimensioned such that gaps between the tabs form complementary profiles of the tabs.

40. A radiant electric heater according to claim 23, wherein the at least one aperture is in the form of at least one hole provided in the discontinuous portion.

41. A radiant electric heater according to claim 23, wherein the width of the discontinuous portion of the strip in a direction perpendicular to the longitudinal direction of the strip and in the plane of the strip is greater than the length of the tabs in said perpendicular direction and the at least one aperture is dimensioned to extend in a direction towards the continuous portion of the strip beyond its associated tab and into the remainder of the discontinuous portion of the strip.

42. A radiant electric heater according to claim 23, wherein the strip is provided of corrugated form along its length.

43. A radiant electric heater according to claim 23, wherein the material of the strip is selected from the group consisting of a metal and a metal alloy.

44. A radiant electric heater according to claim 23, wherein at least one selected region of the heating element is formed with a localised increase in effective cross-sectional area over a predetermined length of the conductive strip such that the at least one selected region operates in a heater at a lower temperature and/or with lower visible radiance than the remainder of the element.

45. A radiant electric heater according to claim 44, wherein the localised increase in cross-sectional area is achieved by increased thickness of the strip.

46. A radiant electric heater according to claim 44, wherein the localised increase in cross-sectional area is achieved by increased effective width of the strip.

47. A radiant electric heater comprising a base of thermal and electrical insulation material and an electrical heating element partially embedded therein, the electrical heating element comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, the tabs being secured on or in the base, there being provided in each tab at least one aperture, whereby thermal conduction into the tabs from the continuous portion is reduced or minimised and also variation in electric current density along the continuous portion of the strip, when energised, is reduced or minimised, wherein a plurality of spaced-apart tabs in at least one selected region of the heating element are replaced by a single elongate tab extending along the at least one selected region without an aperture formed therein to achieve a localised increase in the cross-sectional area over a predetermined length of the conductive strip such that the at least one selected region operates at a lower temperature and/or with a lower visible radiance than the remainder of the element.

48. An electrical heating element for a radiant electric heater, the element comprising an elongate electrically conductive strip adapted for edgewise mounting on a base of thermal and electrical insulation material, the strip comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, for securement in or to the base, there being provided in each tab a single hole, whereby thermal conduction into the tabs from the continuous portion is reduced or minimised and also variation in electric current density along the continuous portion of the strip is reduced or minimised when the strip is electrically connected for operation in a radiant electric heater.

49. An electrical heating element according to claim 48, wherein the width of the discontinuous portion of the strip in a direction perpendicular to the longitudinal direction of the strip and in the plane of the strip is greater than the lengths of the tabs in said perpendicular direction and the hole is dimensioned to extend in a direction towards the continuous portion of the strip beyond its associated tab and into the remainder of the discontinuous portion of the strip.

50. An electrical heating element for a radiant electric heater, the element comprising an elongate electrically conductive strip adapted for edgewise mounting on a base of thermal and electrical insulation material, the strip comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, for securement to or in the base, there being provided in each tab at least one aperture, whereby thermal conduction into the tabs from the continuous portion is reduced or minimised and also variation in electric current density along the continuous portion of the strip is reduced or minimised when the strip is electrically connected for operation in a radiant electric heater, wherein the at least one aperture is omitted from the tabs in at least one selected region of the heating element to achieve a localised increase in cross-sectional area over a predetermined length of the conductive strip such that the at least one selected region operates in a heater at a lower temperature and/or with lower visible radiance than the remainder of the element.

51. An electrical heating element for a radiant electric heater, the element comprising an elongate electrically conductive strip adapted for edgewise mounting on a base of thermal and electrical insulation material, the strip comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, for securement to or in the base, there being provided in each tab at least one aperture, whereby thermal conduction into the tabs from the continuous portion is reduced or minimised and also variation in electric current density along the continuous portion of the strip is reduced or minimised when the strip is electrically connected for operation in a radiant electric heater, wherein a plurality of spaced-apart tabs in at least one selected region of the heating element are replaced by a single elongate tab extending along the at least one selected region without an aperture formed therein to achieve a localised increase in cross-sectional area over a predetermined length of the conductive strip such that the at least one selected region operates in a heater at a lower temperature and/or with lower visible radiance than the remainder of the element.

52. An electrical heating element for a radiant electric heater, the element comprising an elongate electrically conductive strip adapted for edgewise mounting on a base of thermal and electrical insulation material, the strip comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, for securement to or in the base, there being provided in each tab at least one aperture, whereby thermal conduction into the tabs from the continuous portion is reduced or minimised and also variation in electric current density along the continuous portion of the strip is reduced or minimised when the strip is electrically connected for operation in a radiant electric heater, wherein an additional piece of electrically conductive material is bonded to the strip in at least one selected region of the heating element to locally increase the thickness of the strip to achieve a localised increase in cross-sectional area over a predetermined length of the conductive strip such that the at least one selected region operates in a heater at a lower temperature and/or with lower visible radiance than the remainder of the element.

53. An electrical heating element according to claim 52, wherein the additional piece of electrically conductive material bonded to the strip locally increases the width of the strip at the at least one selected region.

54. An electrical heating element according to claim 52, wherein the additional piece of conductive material is formed of the same material as the strip.

55. A radiant electric heater comprising a base of thermal and electrical insulation material and an electrical heating element partially embedded therein, the electrical heating element comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced apart locations, the tabs being secured on or in the base, there being provided in each tab a single hole, whereby thermal conduction into the tabs from the continuous portion is reduced or minimised and also variation in electric current density along the continuous portion of the strip, when energised, is reduced or minimised.

56. A radiant electric heater according to claim 55, wherein the width of the discontinuous portion of the strip in a direction perpendicular to the longitudinal direction of the strip and in the plane of the strip is greater than the length of the tabs in said perpendicular direction and the hole is dimensioned to extend in a direction towards the continuous portion of the strip beyond its associated tab and into the remainder of the discontinuous portion of the strip.

57. A radiant electric heater comprising a base of thermal and electrical insulation material and an electrical heating element partially embedded therein, the electrical heating element comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, the tabs being secured on or in the base, there being provided in each tab at least one aperture, whereby thermal conduction into the tabs from the continuous portion is reduced or minimised and also variation in electric current density along the continuous portion of the strip, when energised, is reduced or minimised, wherein the at least one aperture is omitted from the tabs in at least one selected region of the heating element to achieve a localised increase in cross-sectional area over a predetermined length of the conductive strip such that the at least one selected region operates at a lower temperature and/or with lower visible radiance than the remainder of the element.

58. A radiant electric heater comprising a base of thermal and electrical insulation material and an electrical heating element partially embedded therein, the electrical heating element comprising an elongate electrically conductive strip comprising an elongate continuous portion and a discontinuous portion substantially co-extensive with the continuous portion, the discontinuous portion comprising a plurality of mounting tabs extending in a direction away from the continuous portion at spaced-apart locations, the tabs being secured on or in the base, there being provided in each tab at least one aperture, whereby thermal conduction into the tabs from the continuous portion is reduced or minimised and also variation in electric current density along the continuous portion of the strip, when energised, is reduced or minimised, wherein an additional piece of electrically conductive material is bonded to the strip in at least one selected region of the heating element to locally increase the thickness of the strip to achieve a localised increase in cross-sectional area over a predetermined length of the conductive strip such that the at least one selected region operates at a lower temperature and/or with lower visible radiance than the remainder of the element.

59. A radiant electric heater according to claim 58, wherein the additional piece of conductive material is formed of the same material as the strip.

60. A radiant electric heater according to claim 58, wherein the additional piece of electrically conductive material bonded to the strip locally increases the width of the strip at the at least one selected region.

* * * * *